US006174048B1

(12) United States Patent
Bern

(10) Patent No.: US 6,174,048 B1
(45) Date of Patent: Jan. 16, 2001

(54) DIRECT ELECTROSTATIC PRINTING METHOD AND APPARATUS WITH APPARENT ENHANCED PRINT RESOLUTION

(75) Inventor: Bengt Bern, Mölndal (SE)

(73) Assignee: Array Printers AB, Vastra Frolunda (SE)

( * ) Notice: Under 35 U.S.C. 154(b), the term of this patent shall be extended for 0 days.

(21) Appl. No.: 09/036,049

(22) Filed: Mar. 6, 1998

(51) Int. Cl.[7] ..... B41J 2/06
(52) U.S. Cl. ..... 347/55
(58) Field of Search ..... 347/35, 55, 102, 347/103, 116; 399/301, 302, 308, 388, 394

(56) References Cited

U.S. PATENT DOCUMENTS

| | | | |
|---|---|---|---|
| 3,566,786 | 3/1971 | Kaufer et al. | 101/150 |
| 3,689,935 | 9/1972 | Pressman et al. | 347/55 |
| 3,779,166 | 12/1973 | Pressman et al. | 347/124 |
| 3,815,145 | 6/1974 | Tisch et al. | 347/123 |
| 4,263,601 | 4/1981 | Nishimura et al. | 347/55 |
| 4,274,100 | 6/1981 | Pond | 347/74 |
| 4,353,080 | 10/1982 | Cross | 347/143 |
| 4,382,263 | 5/1983 | Fischbeck et al. | 347/55 |
| 4,384,296 | 5/1983 | Torpey | 347/77 |
| 4,386,358 | 5/1983 | Fischbeck | 347/55 |
| 4,470,056 | 9/1984 | Galetto et al. | 347/145 |
| 4,478,510 | 10/1984 | Fujii et al. | 347/55 |
| 4,491,794 | 1/1985 | Daley et al. | 324/228 |
| 4,491,855 | 1/1985 | Fujii et al. | 347/55 |
| 4,498,090 | 2/1985 | Honda et al. | 347/128 |
| 4,511,907 | 4/1985 | Fukuchi | 347/12 |
| 4,525,727 | 6/1985 | Kohashi et al. | 347/55 |
| 4,571,601 | 2/1986 | Teshima | 347/33 |
| 4,675,703 | 6/1987 | Fotland | 347/127 |
| 4,717,926 | 1/1988 | Hotomi | 347/55 |
| 4,743,926 | 5/1988 | Schmidlin et al. | 347/55 |
| 4,748,453 | 5/1988 | Lin et al. | 347/41 |
| 4,814,796 | 3/1989 | Schmidlin | 347/55 |
| 4,831,394 | 5/1989 | Ochiai et al. | 347/55 |
| 4,860,036 | 8/1989 | Schmidlin | 347/55 |
| 4,903,050 | 2/1990 | Schmidlin | 347/55 |

(List continued on next page.)

FOREIGN PATENT DOCUMENTS

| | | |
|---|---|---|
| 12 70 856 | 6/1968 | (DE) . |
| 26 53 048 | 5/1978 | (DE) . |
| 0 345 024 A2 | 6/1989 | (EP) . |

(List continued on next page.)

OTHER PUBLICATIONS

E. Bassous, et al., "The Fabrication of High Precision Nozzles by the Anisotropic Etching of (100) Silicon", *J. Electrochem. Soc.: Solid–State Science and Technology*, vol. 125, No. 8, Aug. 1978, pp. 1321–1327.

Jerome Johnson, "An Etched Circuit Aperture Array for TonerJet® Printing", *IS & T's Tenth International Congress on Advances in Non–Impact Printing Technologies*, 1994, pp. 311–313.

"The Best of Both Worlds," Brochure of Toner Jet® by Array Printers, *The Best of Both Worlds*, 1990.

* cited by examiner

*Primary Examiner*—Sandra Brase
(74) *Attorney, Agent, or Firm*—Knobbe, Martens, Olson & Bear, LLP

(57) ABSTRACT

A direct electrostatic printing device and method print an image to an information carrier with increased edge smoothness. By controlling the transport of toner particles, dots can, if needed, be adjusted from the exact alignment of a dot matrix to form smoother edges that are not aligned with the dot matrix. The control of toner particle transport can be effectuated by time displacement of the opening and closing of the apertures, and/or modification of the deflection voltages. A further improvement is the control of the deflection voltages for controlling the size of the dots, alone or in combination with the position modification of the dots.

29 Claims, 8 Drawing Sheets

U.S. PATENT DOCUMENTS

| | | | | |
|---|---|---|---|---|
| 4,912,489 | | 3/1990 | Schmidlin | 347/55 |
| 5,028,812 | | 7/1991 | Bartky | 347/12 |
| 5,036,341 | | 7/1991 | Larsson | 347/55 |
| 5,038,159 | | 8/1991 | Schmidlin et al. | 347/55 |
| 5,057,855 | | 10/1991 | Damouth | 347/57 |
| 5,072,235 | | 12/1991 | Slowik et al. | 347/19 |
| 5,083,137 | | 1/1992 | Badyal et al. | 347/57 |
| 5,095,322 | | 3/1992 | Fletcher | 347/55 |
| 5,121,144 | | 6/1992 | Larson et al. | 347/55 |
| 5,128,695 | | 7/1992 | Maeda | 347/55 |
| 5,148,595 | | 9/1992 | Doggett et al. | 347/148 |
| 5,170,185 | | 12/1992 | Takemura et al. | 347/55 |
| 5,181,050 | | 1/1993 | Bibl et al. | 347/148 |
| 5,204,696 | | 4/1993 | Schmidlin et al. | 347/55 |
| 5,204,697 | | 4/1993 | Schmidlin | 347/115 |
| 5,214,451 | | 5/1993 | Schmidlin et al. | 347/55 |
| 5,229,794 | | 7/1993 | Honman et al. | 347/55 |
| 5,235,354 | | 8/1993 | Larson | 347/55 |
| 5,237,346 | | 8/1993 | Da Costa et al. | 347/148 |
| 5,256,246 | | 10/1993 | Kitamura | 216/17 |
| 5,257,045 | | 10/1993 | Bergen et al. | 347/123 |
| 5,270,729 | | 12/1993 | Stearns | 347/128 |
| 5,274,401 | | 12/1993 | Doggett et al. | 347/148 |
| 5,307,092 | | 4/1994 | Larson | 347/124 |
| 5,329,307 | | 7/1994 | Takemura et al. | 347/151 |
| 5,374,949 | | 12/1994 | Wada et al. | 347/112 |
| 5,386,225 | | 1/1995 | Shibata | 347/55 |
| 5,402,158 | | 3/1995 | Larson | 347/151 |
| 5,414,500 | | 5/1995 | Furukawa | 347/55 |
| 5,438,437 | * | 8/1995 | Mizoguchi et al. | 347/118 |
| 5,446,478 | | 8/1995 | Larson | 347/158 |
| 5,450,115 | | 9/1995 | Bergen et al. | 347/123 |
| 5,453,768 | | 9/1995 | Schmidlin | 347/55 |
| 5,473,352 | | 12/1995 | Ishida | 347/55 |
| 5,477,246 | | 12/1995 | Hirabayashi et al. | 347/12 |
| 5,477,250 | | 12/1995 | Larson | 347/55 |
| 5,506,666 | | 4/1996 | Masuda et al. | 347/156 |
| 5,508,723 | | 4/1996 | Maeda | 347/55 |
| 5,510,824 | * | 4/1996 | Nelson | 347/55 |
| 5,515,084 | | 5/1996 | Larson | 347/55 |
| 5,526,029 | | 6/1996 | Larson et al. | 347/55 |
| 5,558,969 | | 9/1996 | Uyttendaele et al. | 347/55 |
| 5,559,586 | | 9/1996 | Wada | 347/55 |
| 5,600,355 | | 2/1997 | Wada | 347/55 |
| 5,614,932 | | 3/1997 | Kagayama | 347/55 |
| 5,617,129 | | 4/1997 | Chizuk, Jr. et al. | 347/55 |
| 5,625,392 | | 4/1997 | Maeda | 347/55 |
| 5,640,185 | | 6/1997 | Kagayama | 347/55 |
| 5,650,809 | | 7/1997 | Kitamura | 347/55 |
| 5,666,147 | | 9/1997 | Larson | 347/112 |
| 5,677,717 | | 10/1997 | Ohashi | 347/69 |
| 5,708,464 | | 1/1998 | Desie | 347/55 |
| 5,774,159 | | 6/1998 | Larson | 347/151 |
| 5,801,729 | * | 9/1998 | Kitamura et al. | 347/55 |
| 5,805,185 | | 9/1998 | Kondo | 347/55 |
| 5,818,480 | | 10/1998 | Bern et al. | 347/55 |
| 5,818,490 | | 10/1998 | Larson | 347/151 |
| 5,847,733 | | 12/1998 | Bern | 347/55 |
| 5,975,683 | * | 11/1999 | Smith et al. | 347/55 |
| 5,984,456 | * | 11/1999 | Bern et al. | 347/55 |

FOREIGN PATENT DOCUMENTS

| | | |
|---|---|---|
| 0 352 997 A2 | 1/1990 | (EP) . |
| 0 377 208 A2 | 7/1990 | (EP) . |
| 0 389 229 | 9/1990 | (EP) . |
| 0 660 201 A2 | 6/1995 | (EP) . |
| 072 072 A2 | 7/1996 | (EP) . |
| 0 743 572 A1 | 11/1996 | (EP) . |
| 0 752 317 A1 | 1/1997 | (EP) . |
| 0 764 540 A2 | 3/1997 | (EP) . |
| 2108432 | 5/1983 | (GB) . |
| 44-26333 | 11/1969 | (JP) . |
| 55-55878 | 4/1980 | (JP) . |
| 55-84671 | 6/1980 | (JP) . |
| 55-87563 | 7/1980 | (JP) . |
| 56-89576 | 7/1981 | (JP) . |
| 58-044457 | 3/1983 | (JP) . |
| 58-155967 | 9/1983 | (JP) . |
| 62 248662 | 10/1987 | (JP) . |
| 62-13356 | 11/1987 | (JP) . |
| 01120354 | 5/1989 | (JP) . |
| 05220963 | 8/1990 | (JP) . |
| 04189554 | 8/1992 | (JP) . |
| 04 268591 | 9/1992 | (JP) . |
| 4282265 | 10/1992 | (JP) . |
| 5208518 | 8/1993 | (JP) . |
| 93331532 | 12/1993 | (JP) . |
| 94200563 | 8/1994 | (JP) . |
| 9048151 | 2/1997 | (JP) . |
| 09118036 | 5/1997 | (JP) . |
| 9014960 | 12/1990 | (WO) . |

DIRECT ELECTROSTATIC PRINTING METHOD AND APPARATUS WITH APPARENT ENHANCED PRINT RESOLUTION

FIELD OF THE INVENTION

The present invention relates to direct electrostatic printing methods in which charged toner particles are transported under control from a particle source in accordance with image information to form a toner image used in a copier, a printer, a plotter, a facsimile, or the like.

BACKGROUND TO THE INVENTION

According to a direct electrostatic printing method, such as that disclosed in U.S. Pat. No. 5,036,341, a background electric field is produced between a developer sleeve and a back electrode to enable the transport of charged toner particles therebetween. A printhead structure, such as an electrode matrix provided with a plurality of selectable apertures, is interposed in the background electric field and connected to a control unit which converts an image information into a pattern of electrostatic control fields which selectively open or close the apertures, thereby permitting or restricting the transport of toner particles from the developer sleeve. The modulated stream of toner particles allowed to pass through opened apertures impinges upon information carrier, such as paper, conveyed between the printhead structure and the back electrode, to form a visible image.

According to such a method, each single aperture is utilized to address a specific dot position of the image in a transverse direction, i.e. perpendicular to paper motion. Thus, the transversal print addressability is limited by the density of apertures through the printhead structure. For instance, a print addressability of 300 dpi requires a printhead structure having 300 apertures per inch in a transversal direction.

A new concept of direct electrostatic printing, hereinafter referred to as dot deflection control (DDC), was introduced in U.S. patent application Ser. No. 08/621,074 (now U.S. Pat. No. 5,847,733). According to the DDC method each single aperture is used to address several dot positions on an information carrier by controlling not only the transport of toner particles through the aperture, but also their transport trajectory toward a paper, and thereby the location of the obtained dot. The DDC method increases the print addressability without requiring a larger number of apertures in the printhead structure. This is achieved by providing the printhead structure with at least two sets of deflection electrodes connected to variable deflection voltages which, during each print cycle, sequentially modify the symmetry of the electrostatic control fields to deflect the modulated stream of toner particles in predetermined deflection directions.

For instance, a DDC method performing three deflection steps per print cycle, provides a print addressability of 600 dpi utilizing a printhead structure having 200 apertures per inch.

An improved DDC method, disclosed in U.S. patent application Ser. No. 08/759,481, (now U.S. Pat. No. 5,984,456) provides a simultaneous dot size and dot position control. This later method utilizes the deflection electrodes to influence the convergence of the modulated stream of toner particles thus controlling the dot size. According to the method, each aperture is surrounded by two deflection electrodes connected to a respective deflection voltage D1, D2, such that the electrical field generated by the control electrodes remains substantially symmetrical as long as both deflection voltages D1, D2 have the same amplitude. The amplitudes of D1 and D2 are modulated to apply converging forces on the toner particles to obtain smaller dots. The dot position is simultaneously controlled by modulating the amplitude difference between D1 and D2. Utilizing this improved method enables 60 $\mu$m dots to be obtained utilizing 160 $\mu$m apertures.

With or without DDC in direct electrostatic printing methods a plurality of apertures, each surrounded by a control electrode, are preferably arranged in parallel rows extending transversally across the print zone, i.e. at a right angle to the motion of the image receiving medium. As a pixel position on the image receiving medium passes beneath a corresponding aperture, the control electrode associated with this aperture is set on a print potential allowing the transport of toner particles through the aperture to form a toner dot at that pixel position. Accordingly, transverse image lines can be printed by simultaneously activating several apertures of the same aperture row.

However, it can be considered a drawback of current direct electrostatic printing methods that image lines or edges that are not parallel, i.e. not aligned to the dot grid, appear stepped. Particularly, image lines disposed at a slight angle to the row direction, being formed of a plurality of transverse line segments, appear unsharp. Therefore, there seems to still exist a need to improve the current direct electrostatic printing method.

SUMMARY OF THE INVENTION

An object of the present invention is to provide a method of and device for improving edge smoothness in direct electrostatic printing methods.

A further object of the present invention is to provide a method of direct electrostatic printing which increases the edge sharpness of an image recorded onto an information carrier.

Still a further object of the present invention is to provide a method of and a device for improving control over dot placement in direct electrostatic printing methods.

Yet a further object of the present invention is to provide a method of and a device for edge enhancement in direct electrostatic printing methods.

Another object of the present invention is to provide a method of and device for reducing or eliminating jaggedness in lines or contours not aligned with the aperture grid in direct electrostatic printing methods.

Still another object of the present invention is to provide a method of and a device for trajecting toner particles to predetermined positions in view of an image which is to be recorded.

Said objects are achieved according to the invention by providing a direct electrostatic printing device and method for printing an image to an information carrier with increased edge smoothness. By controlling the transport of toner particles, dots can, if needed, be adjusted from the exact alignment of a dot matrix to form smoother edges that are not aligned with the dot matrix. The control of toner particle transport can be effected by time displacement of the opening and closing of the apertures, and/or modification of the deflection voltages. A further improvement is the control of the deflection voltages for controlling the size of the dots, alone or in combination with one or both of the position modifications of the dots.

Said objects are also achieved according to the invention by an image printing device and method for printing an image onto an information carrier. The direct electrostatic printing device includes a pigment particle source, a voltage source, a printhead structure, a control unit, and an image receiving member. The pigment particle source provides pigment particles. The image receiving member and the printhead structure move relative to each other during printing. The image receiving member has a first face and a second face. The printhead structure is placed between the pigment particle source and the first face of the image receiving member. The voltage source is connected to the pigment particle source and the back electrode to thereby create an electrical field for transport of pigment particles from the pigment particle source toward the first face of the image receiving member. The printhead structure includes control electrodes connected to the control unit to thereby selectively open or close apertures through the printhead structure to permit or restrict the transport of pigment particles to thereby enable the formation of a pigment image on the first face of the image receiving member nominally aligned with a dot matrix. According to the invention the control unit controls the transport of pigment particles in such a way that edges of image features, not aligned with the dot matrix, of the image which is to be printed, appear smoother, i.e. smoother than if the edges of features not aligned with the dot matrix where printed aligned with the dot matrix.

In certain embodiments according to the invention the control unit controllably time displaces the selective opening and closing of apertures to thereby enable a modified dot position adjustment, beyond the dot matrix, in a direction mainly parallel to the direction of the relative movement between the image receiving member and the printhead structure. The time displacement can preferably be both positive and negative depending on the edges of image features of the image to be printed.

The printhead structure of the image printing device advantageously includes deflection electrodes connected to the control unit for controlling the deflection of pigment particles in transport to thereby be able to deflect pigment particles toward predetermined locations not aligned with to the dot matrix on the first face of the image receiving member in view of the image which is to be printed by means of predetermined deflection voltages. Advantageously the control unit controllably adjusts the deflection voltages to thereby enable a modified dot position adjustment, beyond the dot matrix, in a direction mainly perpendicular to the direction of the relative movement between the image receiving member and the printhead structure, so that edges of image features, not aligned with the dot matrix, of the image which is to be printed, appear smoother. Preferably the control unit further controllably adjusts the deflection voltages to thereby enable a dot size adjustment in conjunction with the position modification or on its own for edge improvement.

Certain embodiments of the printhead structure of the image printing device suitably include deflection electrodes connected to the control unit for controlling the deflection of pigment particles in transport to thereby be able to deflect pigment particles toward predetermined locations not aligned with to the dot matrix on the first face of the image receiving member in view of the image which is to be printed by means of predetermined deflection voltages. In these embodiments the control unit controllably adjusts the deflection voltages to thereby enable a dot size adjustment for image enhancement.

Still, in further embodiments according to the invention, suitably the control unit controllably time displaces the selective opening and closing of apertures to thereby enable a modified dot position adjustment, beyond the dot matrix, in a direction mainly parallel to the direction of the relative movement between the image receiving member and the printhead structure. In these embodiments the printhead structure includes deflection electrodes connected to the control unit for controlling the deflection of pigment particles in transport to thereby be able to deflect pigment particles towards predetermined locations not aligned with the dot matrix on the first face of the image receiving member in view of the image which is to be printed by means of predetermined deflection voltages. The control unit controllably adjusts the deflection voltages to thereby enable a modified dot position adjustment, beyond the dot matrix, in a direction mainly perpendicular to the direction of the relative movement between the image receiving member and the printhead structure. This will enable, in combination, a possible two-dimensional modified dot position adjustment beyond the dot matrix. This will enable edges of image features, not aligned with the dot matrix, of the image which is to be printed, to appear smoother, i.e. smoother than if the edges of features not aligned with the dot matrix were printed aligned with the dot matrix.

Preferably the image recording device comprises a format controller that determines if an image dot resides at an edge of an image feature of an image to be printed. The format controller will select a dot modification for image dots residing at the edge for which a modification improves the printed image, to thereby enhance the edge. The format controller also generates commands to the control unit for control of the transport of pigment particles in dependence of the possible selected dot modifications.

In some embodiments the image printing device comprises an image receiving member position measuring means for measuring the position of the image receiving member in relation to the apertures to thereby, via the control unit be able to synchronize the selective opening and closing of the apertures through the printhead structure according to the relative movement of the printhead structure and the image receiving member to form a pigment image at a predetermined position on the image receiving member in view of the image which is to be printed. The image printing device preferably also includes at least two pigment particle sources with their respective corresponding control electrodes and apertures, whereby the image receiving member position measuring means measures the position of the image receiving means in relation to the respective apertures to thereby via the control unit synchronize the selective opening and closing of the respective apertures through the at least one printhead structure according to the relative movement of the at least one printhead structure and the image receiving member to thereby enable the formation of a respective pigment image at a predetermined position on the image receiving member in view of the image which is to be printed. Preferably, the image printing device is capable of printing color images and includes four pigment particle sources.

In some embodiments the image receiving member is an information carrier.

In other embodiments the image receiving member includes a transfer belt positioned at a predetermined distance from the printhead structure. The transfer belt has a substantially uniform thickness. A pigment image is subsequently transferred to an information carrier. The transfer belt is preferably supported by at least one holding element arranged on the side of the second face of the transfer belt adjacent to the print station. The first face of the image receiving member is preferably substantially evenly coated with a layer of bouncing reduction agent thus providing a surface on the first face of the image receiving member that the pigment particles transported through the print head structure adhere to substantially without bouncing. The bouncing reduction agent can advantageously be a liquid having adhesion properties suitable for the adhesion of pigment particles to the first face of the image receiving member. The image printing device further preferably comprises a film application means for applying the bouncing reduction agent liquid substantially evenly as a film layer onto the first face of the image receiving member. The bouncing reduction agent is advantageously a silicone oil having appropriate adhesion properties for reducing bouncing of pigment particles when pigment particles are transferred onto the first face of the image receiving means and also having appropriate release properties when a pigment image is transferred to an information carrier from the image receiving member. The image printing device further advantageously comprises a transfuser having heating means and pressurizing means for transferring a pigment image on the surface of the first face of the image receiving member to an information carrier by locally applying heat and pressure to the information carrier and the pigment image by the heating means and pressurizing means, and thereby transferring the pigment image to the information carrier. The image printing device preferably also comprises a pressure changing means which can create a pressure difference on the side of the second face of the image receiving member in the vicinity of the apertures of the printhead structure. The image receiving member preferably comprises a cleaning area for cleaning purposes and a separate image area intended for reception of pigment particles for formation of a pigment image thereon, where the cleaning area includes at least one slot between the first face and the second face intended for transmitting the pressure difference through the image receiving member to thereby, in cooperation with the pressure changing means in the vicinity of the apertures of the printhead structure, dislodge pigment agglomeration for cleaning the apertures of the printhead structure.

The printing device will in some embodiments advantageosuly include at least two pigment particle sources with corresponding control electrodes and apertures on and in at least one printhead structure. The image printing device will in other embodiments advantageously include four pigment particle sources with corresponding control electrodes and apertures on and in at least one printhead structure.

The printhead structure can preferably in some embodiments include deflection electrodes connected to the control unit to thereby be able to deflect pigment particles toward predetermined locations on the first face of the image receiving member in view of the image which is to be printed.

In other embodiments the printhead structure includes deflection electrodes connected to the control unit for controlling the deflection of pigment particles in transport, and where the image printing device further comprises deflection control feedback means for providing a deflection feedback signal to the control unit to thereby control the deflection electrodes in such a way that pigment particles are, for formation of a pigment image on the image receiving member in view of the image which is to be printed, trajected toward predetermined locations on the image receiving member.

Said objects are also achieved according to the invention by a method for printing an image to an information carrier. The method comprises a number of steps. In a first step pigment particles are provided from a pigment particle source. In a second step an image receiving member and a printhead structure are moved relative to each other during printing. In a third step an electrical field is created for transporting pigment particles from the pigment particle source toward the first face of the image receiving member. In a fourth step apertures through a printhead structure are selectively opened or closed to permit or restrict the transporting of pigment particles to form a pigment image on the first face of the image receiving member nominally aligned with a dot matrix. And in a final sixth step controlling the transport of pigment particles in such a way that edges of image features, not aligned with the dot matrix, of the image which is to be printed, appear smoother, i.e. smoother than if the edges of features not aligned with the dot matrix were printed aligned with the dot matrix.

Further variations of the method according to previously described enhancements are possible in view of the application of the invention.

The present invention satisfies a need for increased accuracy of dot placement control in direct electrostatic printing methods and apparatus by providing control to modify dot placement by time displacement of the closing and opening of the apertures and adjustment of the deflection voltages.

The present invention relates to an image recording apparatus including an image receiving member conveyed past one or more print stations to intercept a modulated stream of toner particles from each print station. A print station includes a particle delivery unit, a particle source, such as a developer sleeve, and a printhead structure arranged between the particle source and the image receiving member. The printhead structure includes means for modulating the stream of toner particles from the particle source and means for controlling the trajectory of the modulated stream of toner particles toward the image receiving member.

According to a preferred embodiment of the present invention, the image recording apparatus comprises four print stations, each corresponding to a pigment color, e.g. yellow, magenta, cyan, black (Y,M,C,K), disposed adjacent to an image receiving member formed of a seamless transfer belt made of a substantially uniformly thick, flexible material having high thermal resistance, high mechanical strength and stable electrical properties under a wide temperature range. The toner image is formed on the transfer belt and thereafter brought into contact with an information carrier, e.g. paper, in a fuser unit, where the toner image is simultaneously transferred to and made permanent on the information carrier upon heat and pressure. After image transfer, the transfer belt is brought in contact with a cleaning unit which removes untransferred toner particles.

The present invention also relates to a direct printing method performed in consecutive print cycles, each of which includes several development periods having specific deflection modes. During each development period, control voltages are applied to control electrodes to produce electrostatic control fields which, due to control in accordance with the image information, open or close apertures through the printhead structure, thus enhancing or inhibiting the transport of toner particles from the particle source toward the image receiving member. According to the invention the opening and closing of apertures can be time displaced to modify the dot position of determined dots to thereby enhance edge smoothness. Deflection voltages are simultaneously applied to the deflection electrodes to influence the symmetry of the electrostatic control fields to deflect the transported toner particles in predetermined directions, such that several dot locations are addressable through each aperture during each print cycle. The deflection length, i.e. the distance between a deflected dot and a central axis of the corresponding aperture, is optimized to obtain uniformly spaced dot locations across the entire width of the image receiving member. According to the invention the deflection lengths can be modified to thereby reposition determined dots to improve the smoothness of edges.

Other objects, features and advantages of the present inventions will become more apparent from the following description when read in conjunction with the accompanying drawings in which preferred embodiments of the invention are shown by way of illustrative examples.

BRIEF DESCRIPTION OF THE DRAWINGS

The invention will now be described in more detail for explanatory, and in no sense limiting, purposes, with reference to the following drawings, wherein like reference numerals designate like parts throughout and where the dimensions in the drawings are not to scale, in which.

DESCRIPTION OF PREFERRED EMBODIMENTS

In order to clarify the method and device according to the invention, some examples of its use will now be described in connection with FIGS. 1 to 8.

Figure 1:
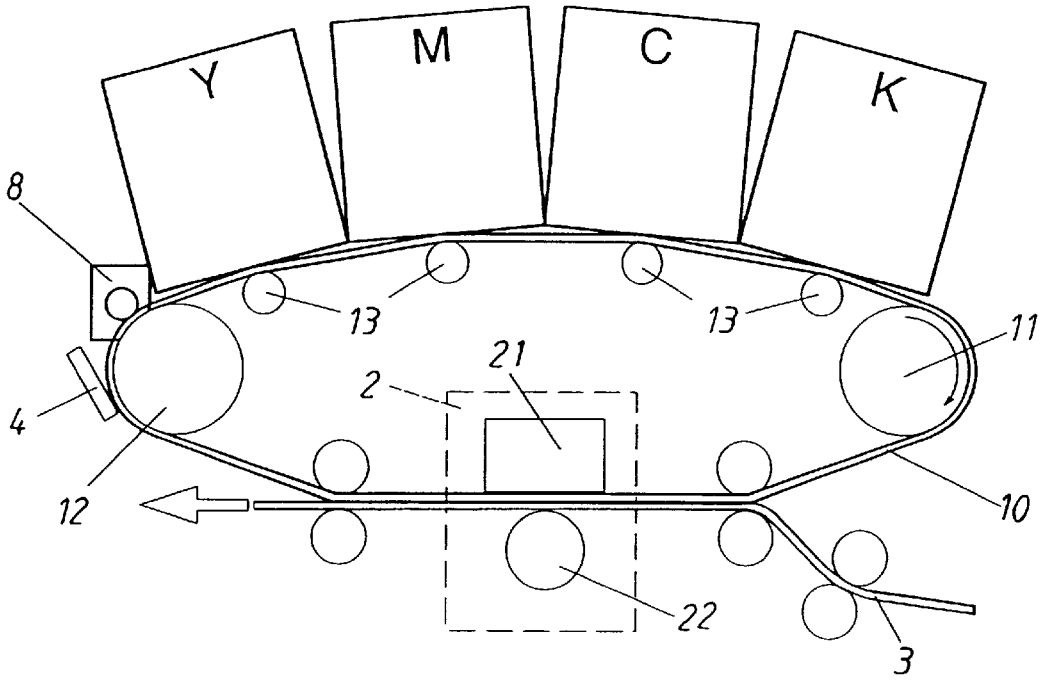
FIG. 1 is a schematic section view across an image recording apparatus according to a preferred embodiment of the invention.

FIG. 1 is a schematic section view of an image recording apparatus according to a first embodiment of the invention, comprising at least one print station, preferably four print stations (Y, M, C, K), an intermediate image receiving member, a driving roller 11, at least one support roller 12, and preferably several adjustable holding elements 13. The four print stations (Y, M, C, K) are arranged in relation to the intermediate image receiving member. The intermediate image receiving member, preferably a transfer belt 10, is mounted over the driving roller 11. The at least one support roller 12 is provided with a mechanism for maintaining the transfer belt 10 with a constant surface tension, while preventing transversal movement of the transfer belt 10. The several adjustable holding elements 13 are for accurately positioning the transfer belt 10 at least with respect to each print station.

The driving roller 11 is preferably a cylindrical metallic sleeve having a rotational axis extending perpendicular to the belt motion and a rotation velocity adjusted to convey the transfer belt 10 at a velocity of one addressable dot location per print cycle, to provide line by line scan printing. The adjustable holding elements 13 are arranged for maintaining the surface of the transfer belt 10 at a predetermined distance from each print station. The holding elements 13 are preferably cylindrical sleeves disposed perpendicularly to the belt motion in an arcuate configuration for slightly bending the transfer belt 10 at least in the vicinity of each print station. The transfer belt 10 is slightly bent in order to, in combination with the belt tension, create a stabilization force component on the transfer belt 10. The stabilization force component is opposite in direction and preferably larger in magnitude than an electrostatic attraction force component acting on the transfer belt 10. The electrostatic attraction forces at a print station are created by induction charging of the belt and by different electric potentials on the holding elements 13 and on the print station in question.

The transfer belt 10 is preferably an endless band of 30 to 200 μm thick composite material as a base. The base composite material can suitably include thermoplastic polyamide resin or any other suitable material having a high thermal resistance (e.g., glass transition point of 260° C. and melting point of 388° C.), and stable mechanical properties under temperatures of the order of 250° C. The composite material of the tranfer belt 10 preferably has a homogeneous concentration of filler material, such as carbon or the like, which provides a uniform electrical conductivity throughout the entire surface of the transfer belt 10. The outer surface of the transfer belt 10 is preferably overlaid with a 5 to 30 μm thick coating layer made of electrically conductive polymer material such as for instance PTFE (poly tetra fluoro ethylene), PFA (tetra flouro ethylene, perflouro alkyl vinyl ether copolymer), FEP (tetra flouro ethylene hexaflouro, propylene copolymer), silicone, or any other suitable material having appropriate conductivity, thermal resistance, adhesion properties, release properties, and surface smoothness. To further improve the adhesion and release properties, a layer of silicone oil can be applied to the transfer belt base or, preferably, the layer of silicon oil is applied to a coating layer that is applied onto the transfer belt base. The silicone oil is coated evenly onto the transfer belt 10 preferably of the order of 0.1 to 2 μm thick giving a consumption of silicone oil in the region of 1 centiliter for every 1000 pages. Silicone oil also reduces bouncing/scattering of toner particles upon reception of toner particles and also increases the subsequent transfer of toner particles to an information carrier. Use of silicone oil and especially coating of the transfer belt with silicone oil is possible in an electrostatic printing method according to the present invention as there is no direct physical contact between a toner source and a toner recipient, i.e. the transfer belt, in this embodiment.

In some embodiments the transfer belt 10 can comprise at least one separate image area and at least one of a cleaning area and/or a test area. The image area is intended for the deposition of toner particles, the cleaning area is intended for removing of unwanted toner particles from around each of the print stations, and the test area is intended for receiving test patterns of toner particles for calibration purposes. The transfer belt 10 can also in certain embodiments comprise a special registration area for use of determining the position of the transfer belt, especially an image area if available, in relation to each print station. If the transfer belt comprises a special registration area, then this area is preferably spatially related to an image area.

The transfer belt 10 is conveyed past the four different print stations (Y, M, C, K), whereby toner particles are deposited on the outer surface of the transfer belt 10 and superposed to form a toner image. Toner images are then preferably conveyed through a fuser unit 2, comprising a fixing holder 21 arranged transversally in direct contact with the inner surface of the transfer belt. In some embodiments of the invention the fuser unit is separated from the transfer belt 10 and only acts on an information carrier. The fixing holder 21 includes a heating element preferably of a resistance type of e.g. molybdenium, maintained in contact with the inner surface of the transfer belt 10. As an electric current is passed through the heating element, the fixing holder 21 reaches a temperature required for melting the toner particles deposited on the outer surface of the transfer belt 10. The fuser unit 2 further comprises a pressing roller 22 arranged transversally across the width of the transfer belt 10 and facing the fixing holder 21. An information carrier 3, such as a sheet of plain, untreated paper or any other medium suitable for direct printing, is fed from a paper delivery unit (not shown) and conveyed between the pressing roller 22 and the transfer belt 10. The pressing roller 22 rotates with applied pressure to the heated surface of the fixing holder 21 whereby the melted toner particles are fused on the information carrier 3 to form a permanent image. After passage through the fusing unit 2, the transfer belt is brought in contact with a cleaning element 4, such as for example a replaceable scraper blade of fibrous material extending across the width of the transfer belt 10 for removing all untransferred toner particles. If the transfer belt 10 is to be coated with silicone oil or the like, then preferably after the cleaning element 4, and before the printing stations, the transfer belt 10 is brought into contact with a coating application element 8 for evenly coating the transfer belt with silicone oil or the like. In other embodiments, toner particles are deposited directly onto an information carrier without first being deposited onto an intermediate image receiving member.

Figure 2:
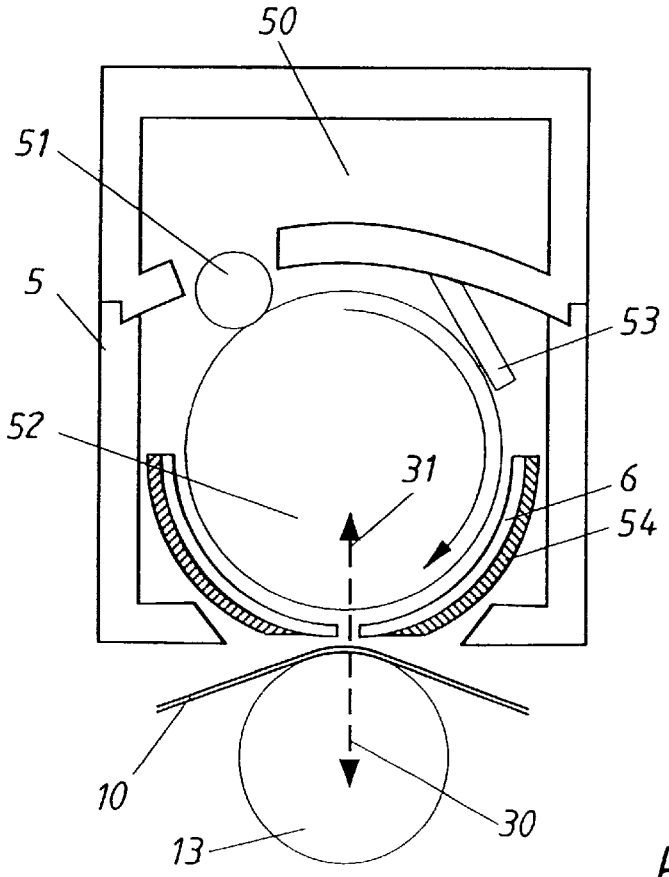
FIG. 2 is a schematic section view across a particular print station of the image recording apparatus shown in FIG. 1.

FIG. 2 is a schematic section view of one embodiment of a print station in, for example, the image recording apparatus shown in FIG. 1. A print station includes a particle delivery unit 5 preferably having a replaceable or refillable container 50 for holding toner particles, the container 50 having front and back walls, a pair of side walls and a bottom wall having an elongated opening extending from the front wall to the back wall and provided with a toner feeding element (not shown) disposed to continuously supply toner particles to a developer sleeve 52 through a particle charging member. The particle charging member can preferably be formed of a supply brush 51 or a roller made of or coated with a fibrous, resilient material. The supply brush 51 can suitably in some embodiments be brought into mechanical contact with the peripheral surface of the developer sleeve 52, for charging particles by contact charge exchange due to triboelectrification of the toner particles through frictional interaction between the fibrous material on the supply brush 51 and any suitable coating material of the developer sleeve 52. The developer sleeve 52 is preferably made of metal which can, for example, be coated with a conductive material, and preferably have a substantially cylindrical shape and a rotation axis extending parallel to the elongated opening of the particle container 50. Charged toner particles are held to the surface of the developer sleeve 52 by electrostatic forces essentially proportional to $(Q/D)^2$, where Q is the particle charge and D is the distance between the particle charge center and the boundary of the developer sleeve 52. Alternatively, the charging unit may additionally comprise a charging voltage source (not shown), which supplies an electric field to induce or inject charge onto the toner particles. Although it is preferred to charge particles through contact charge exchange, the method can be performed by using any other suitable charge unit, such as a conventional charge injection unit, a charge induction unit or a corona charging unit, without departing from the scope of the present invention.

A metering element 53 is positioned proximate to the developer sleeve 52 to adjust the concentration of toner particles on the peripheral surface of the developer sleeve 52, to form a relatively thin, uniform particle layer thereon. In some embodiments the metering element 53 also suitably contributes to the charging of the toner particles. The metering element 53 may be formed of a flexible or rigid, insulating or metallic blade, roller or any other member suitable for providing a uniform particle layer thickness. The metering element 53 may also be connected to a metering voltage source (not shown) which influences the triboelectrification of the particle layer to ensure a uniform particle charge distribution and mass density on the surface of the developer sleeve 52.

The developer sleeve 52 is arranged in relation with a support device 54 for supporting and maintaining the printhead structure 6 in a predetermined position with respect to the peripheral surface of the developer sleeve 52. The support device 54 is preferably in the form of a trough-shaped frame having two side walls, a bottom portion between the side walls, and an elongated slot arranged through the bottom portion, extending transversally across the print station, parallel to the rotation axis of the developer sleeve 52. The support device 54 further comprises means for maintaining the printhead structure in contact with the bottom portion of the support device 54, the printhead structure 6 thereby bridging the elongated slot in the bottom portion.

The transfer belt 10 is preferably slightly bent partly around each holding element 13 in order to create a stabilization force component 30. The stabilization force component 30 is intended to counteract, among other things, a field force component 31 which is acting on the transfer belt. If the field force component 31 is not counteracted it can cause distance fluctuations between the transfer belt 10 and the printhead structure 6 which can cause a degradation in print quality.

Figure 3:
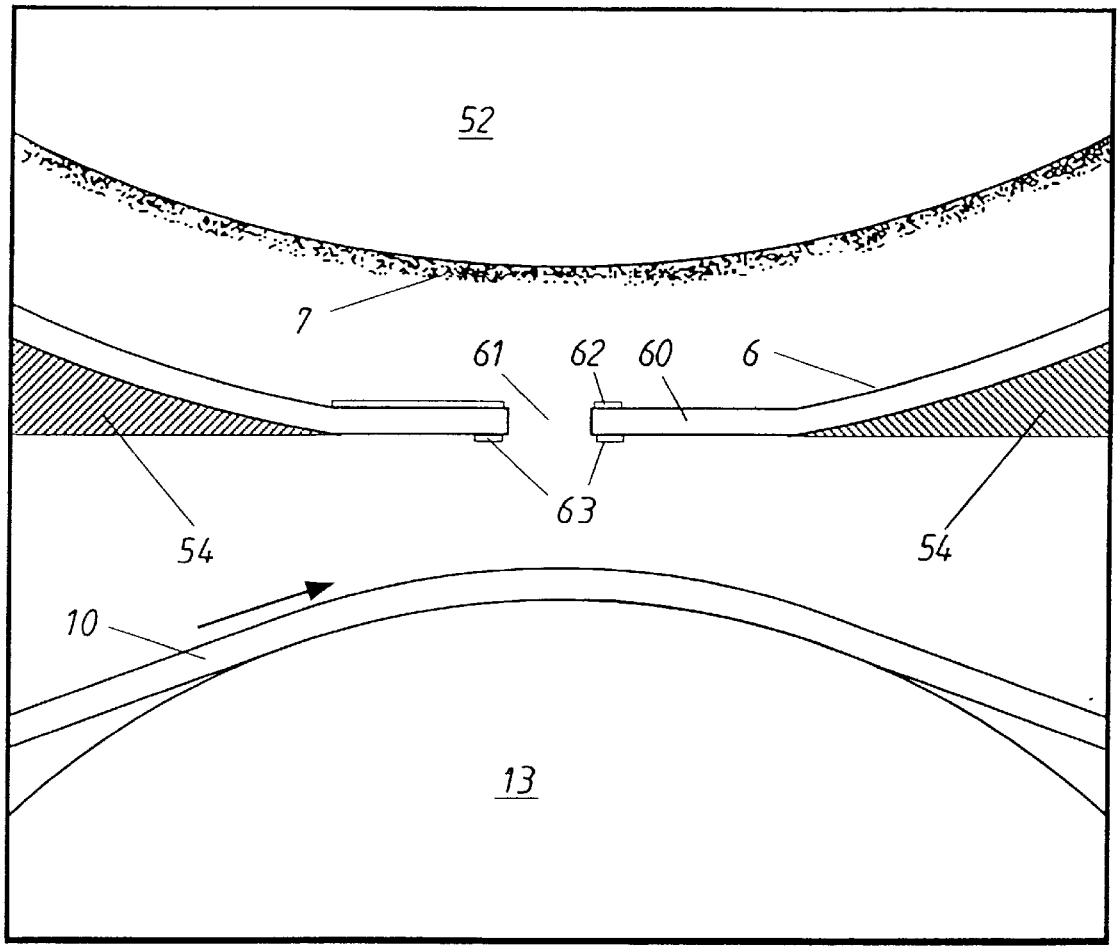
FIG. 3 is an enlargement of FIG. 2 showing the print zone corresponding to a particular print station.

FIG. 3 is an enlargement of the print zone in a print station of, for example, the image recording apparatus shown in FIG. 1. A printhead structure 6 is preferably formed of an electrically insulating substrate layer 60 made of flexible, non-rigid material such as polyamide or the like. The printhead structure 6 is positioned between a peripheral surface of a developer sleeve 52 and a bottom portion of a support device 54. The substrate layer 60 has a top surface facing a toner layer 7 on the peripheral surface of the developer sleeve 52. The substrate layer 60 has a bottom surface facing the bottom portion of the support device 54. Further, the substrate layer 60 has a plurality of apertures 61 arranged through the substrate layer 60 in a part of the substrate layer 60 overlying an elongated slot in the bottom portion of the support device 54. The printhead structure 6 further preferably includes a first printed circuit arranged on the top surface of the substrate layer 60 and a second printed circuit arranged on the bottom surface of the substrate layer 60. The first printed circuit includes a plurality of control electrodes 62, each of which, at least partially, surrounds a corresponding aperture 61 in the substrate layer 60. The second printed circuit preferably includes at least a first and a second set of deflection electrodes 63 spaced around first and second portions of the periphery of the apertures 61 of the substrate layer 60.

The apertures 61 and their surrounding area will under some circumstances need to be cleaned from toner particles which agglomerate there. In some embodiments of the invention the transfer belt 10 advantageously comprises at least one cleaning area for the purpose of cleaning the apertures 61 and the general area of the apertures 61. The cleaning, according to these embodiments, works by the principle of flowing air (or other gas). A pressure difference, compared to the air pressure in the vicinity of the apertures, is created on the side of the transfer belt 10 that is facing away from the apertures 61. The pressure difference is created during part of the time when the cleaning area is in the vicinity of the apertures 61 of the print station in question during, the movement of transfer belt 10. The pressure difference can either be an over pressure, a suction pressure or a sequential combination of both, i.e. the cleaning is performed by either blowing, suction, blowing first then suction, suction first then blowing, or some other sequential combination of suction and blowing. The pressure difference is transferred across the transfer belt 10 by means of the cleaning area comprising at least one slot/hole through the transfer belt 10. The cleaning area preferably comprises at least one row of slots, and more specifically two to eight interlaced rows of slots. The slots can advantageously be in the order of 3 to 5 mm across. The pressure difference appears on the holding element 13 side of the transfer belt 10 through a transfer passage in the holding element 13. The transfer passage can advantageously suitably extend transversally across the printhead structure as an elongated slot with a width, in the direction of the transfer belt 10 movement, that is equal to or greater than the minimum distance between the printhead structure 6 and the transfer belt 10. In some embodiments it can be advantageous to have a controllable passage which can open and close access of the pressure difference to the transfer passage. Thereby a suction pressure will not increase the transfer belt's friction on the holding element 13 more than necessary. The controllable passage will preferably open and close in synchronization with the movement of the transfer belt 10 to thereby coincide its openings with the passage of the cleaning area of the transfer belt 10. The means for creating the pressure difference is also not shown and can suitably be a fan, bellows, a piston, or some other suitable means for creating a pressure difference. In some embodiments according to the invention the transfer passage is substantially located symmetrically in relation to the apertures. In other embodiments according to the invention the transfer passage is shifted in relation to the direction of movement of the transfer belt 10.

Figure 4A:
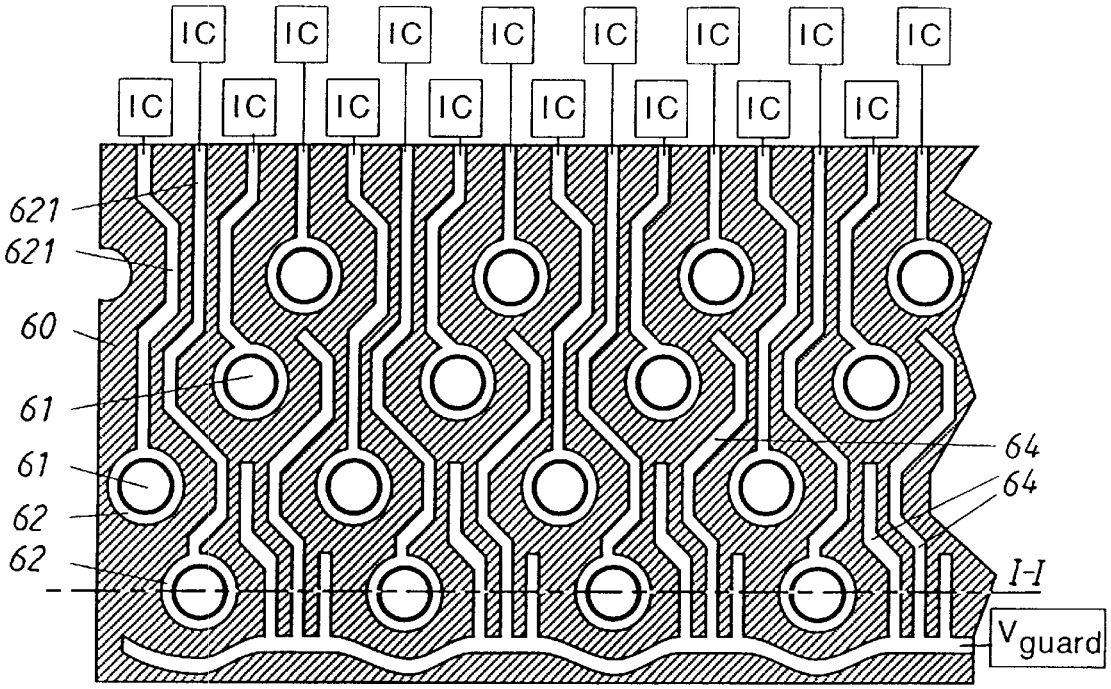
FIG. 4*a* is a schematic plan view of the top side of a printhead structure used in a print station such as that shown in FIG. 2.
Figure 4B:
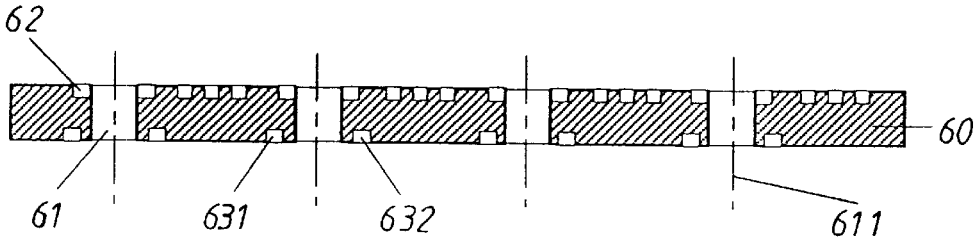
FIG. 4*b* is a schematic section view along the section line I—I through the printhead structure shown in FIG. 4*a*.
Figure 4C:
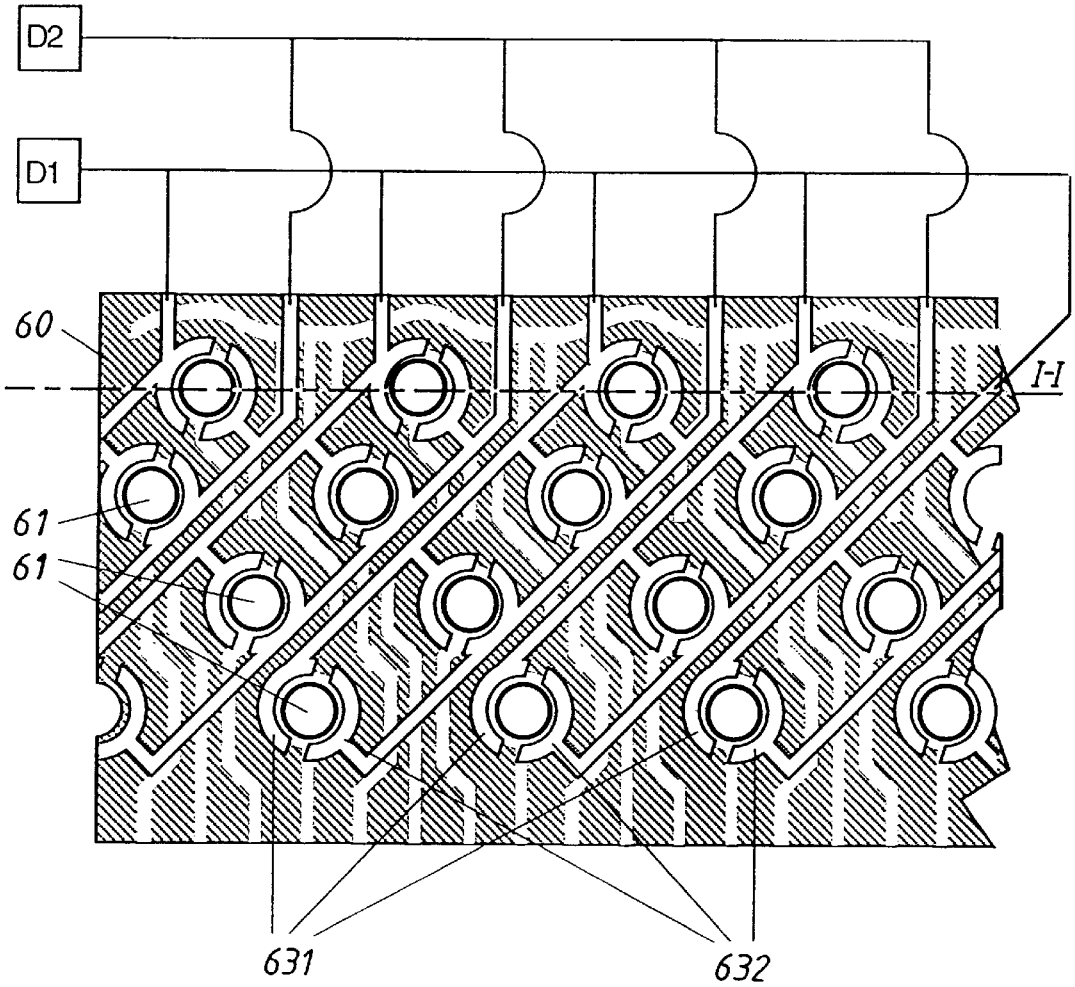
FIG. 4*c* is a schematic plan view of the bottom side of the printhead structure shown in FIG. 4*a*.

Although a printhead structure 6 can take on various embodiments without departing from the scope of the present invention, a preferred embodiment of the printhead structure will be described hereinafter with reference to FIGS. 4*a,* 4*b* and 4*c*. A plurality of apertures 61 are arranged through the substrate layer 60 in several aperture rows extending transversally across the width of the print zone, preferably at a substantially right angle to the motion of the transfer belt. The apertures 61 preferably have a circular cross section with a central axis 611 extending perpendicularly to the substrate layer 60 and suitably a diameter in the order of 100 $\mu$m to 160 $\mu$m. Each aperture 61 is surrounded by a control electrode 62 having a ring-shaped part circumscribing the periphery of the aperture 61, with a symmetry axis coinciding with the central axis 611 of the aperture 61 and an inner diameter which is equal or larger than the aperture diameter. Each control electrode 62 is connected to a control voltage source (IC driver) through a connector 621. As apparent in FIG. 5, the printhead structure further preferably includes guard electrodes 64, preferably arranged on the top surface of the substrate layer 60 and connected to a guard potential (Vguard) aimed to, among other things, decrease the influence on the toner layer and to electrically shield the control electrodes 62 from one another, thereby preventing undesired interaction between the electrostatic fields produced by two adjacent control electrodes 62. Each aperture 61 is related to a first deflection electrode 631 and a second deflection electrode 632 spaced around a first and a second segment of the periphery of the aperture 61, respectively. The deflection electrodes 631, 632 are preferably semicircular or crescent-shaped and are disposed symmetrically on each side of a deflection axis extending diametrically across the aperture at a predetermined deflection angle to the motion of the transfer belt. Thus, the first deflection electrode 631 and the second deflection electrode 632 substantially border on a first half and a second half, respectively, of the circumference of their corresponding aperture 61. All first and second deflection electrodes 631, 632 are connected to a first and a second deflection voltage source D1, D2, respectively.

Figure 5:
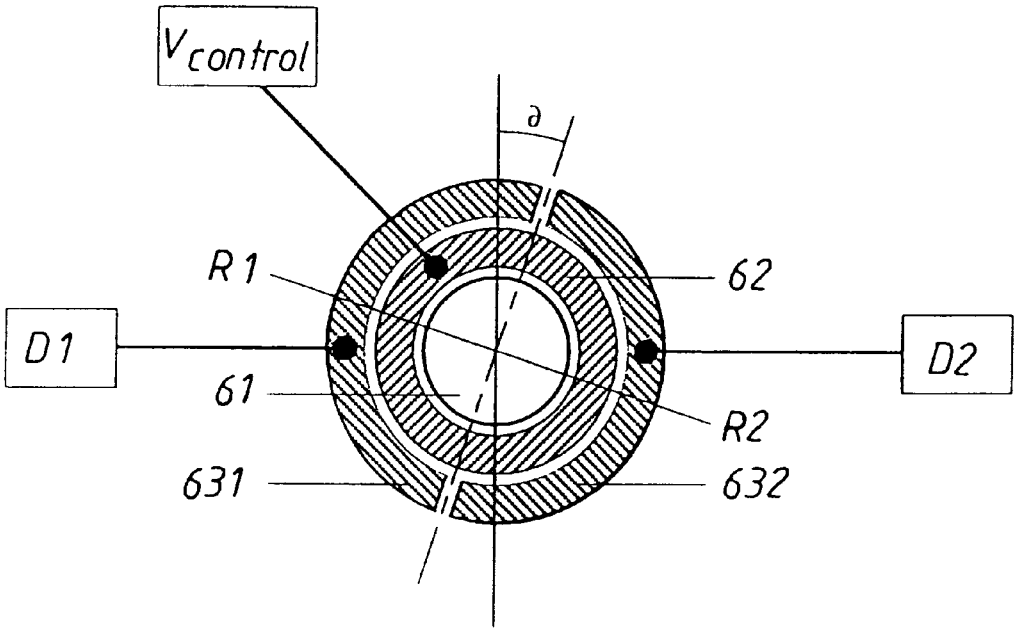
FIG. 5 is a schematic view of a single aperture and its corresponding control electrode and deflection electrodes.

FIG. 5 is a schematic view of a single aperture 61 and its corresponding control electrode 62 and deflection electrodes 631, 632. Toner particles are deflected in a first deflection direction R1 when D1<D2, and an opposite direction R2 when D1>D2. The deflection angle $\delta$ is chosen to compensate for the motion of the transfer belt 10 during the print cycle, in order to be able to obtain two or more transversally aligned dots.

Figure 6A:
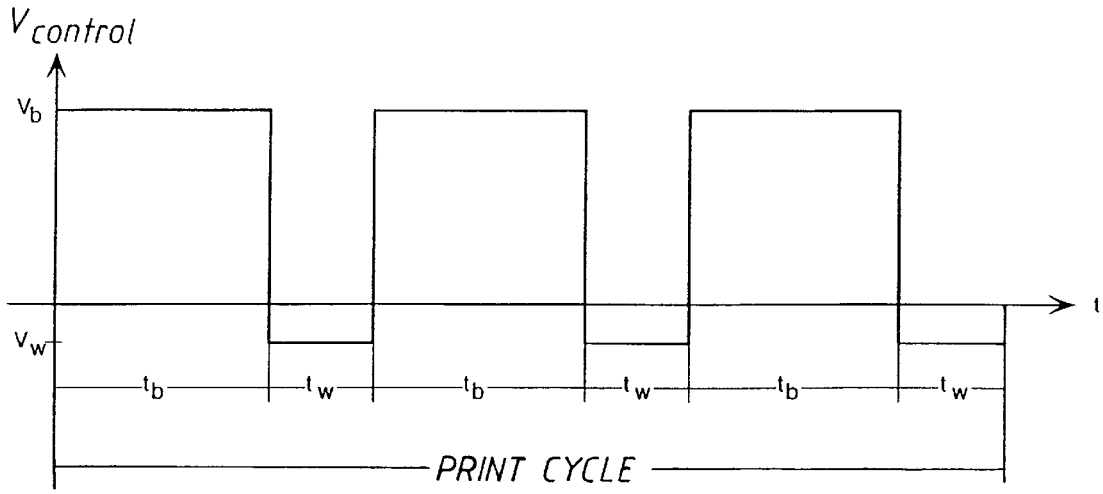
FIG. 6*a* illustrates a control voltage signal as a function of time during a print cycle having three subsequent development periods.

A preferred embodiment of a dot deflection control function is illustrated in FIGS. 6*a,* 6*b* and 6*c* respectively showing the control voltage signal ($V_{control}$), a first deflection voltage D1 and a second deflection voltage D2, as a function of time during a single print cycle. According to some embodiments of the invention and as illustrated in FIGS. 6*a,* 6*b,* and 6*c* printing is performed in print cycles having three subsequent print sequences with corresponding development periods for addressing three different dot locations through each aperture. In other embodiments each print cycle can suitably have fewer or more addressable dot locations for each aperture. In still further embodiments each print cycle has a controllable number of addressable dot locations for each aperture. During the whole print cycle an electric background field is produced between a first potential on the surface of the developer sleeve and a second potential on the back electrode, to enable the transport of toner particles between the developer sleeve and the transfer belt. During each development period, control voltages are applied to the control electrodes to produce a pattern of electrostatic control fields which due to control in accordance with the image information, selectively open or close the apertures by influencing the electric background field, thereby enhancing or inhibiting the transport of toner through the printhead structure. The toner particles allowed to pass through the opened apertures are then transported toward their intended dot location along a trajectory which is determined by the deflection mode.

The examples of control function shown in FIGS. 6*a,* 6*b* and 6*c* illustrate a control function wherein the toner particles have negative polarity charge. As is apparent from FIG. 6*a,* a print cycle comprises three development periods $t_b$, each followed by a recovering period $t_w$ during which new toner is supplied to the print zone. The control voltage pulse ($V_{control}$) can be amplitude and/or pulse width modulated, to allow the intended amount of toner particles to be transported through the aperture. For instance, the amplitude of the control voltage varies between a non-print level $V_w$ of approximately −50V and a print level $V_b$ on the order of +350V, corresponding to full density dots. Similarly, the pulse width can be varied from 0 to $t_b$.

According to the invention the control of the position of a dot location can be increased to produce an apparent increase of the print resolution. A method of achieving this according to the invention is to individually control the timing of each developer period, i.e. individually control the timing of the opening and closing of the apertures. By individually controlling the timing for each developer period for each aperture, each dot location can be repositioned in a direction which is mainly parallel to the direction of travel of the image receiving member, information carrier, or transfer belt. Thus according to the invention individual dot positions can be moved/adjusted forward or backward, i.e. in a direction parallel to the direction of travel of the information carrier, by time displacing the opening and closing of the apertures.

Figure 6B:
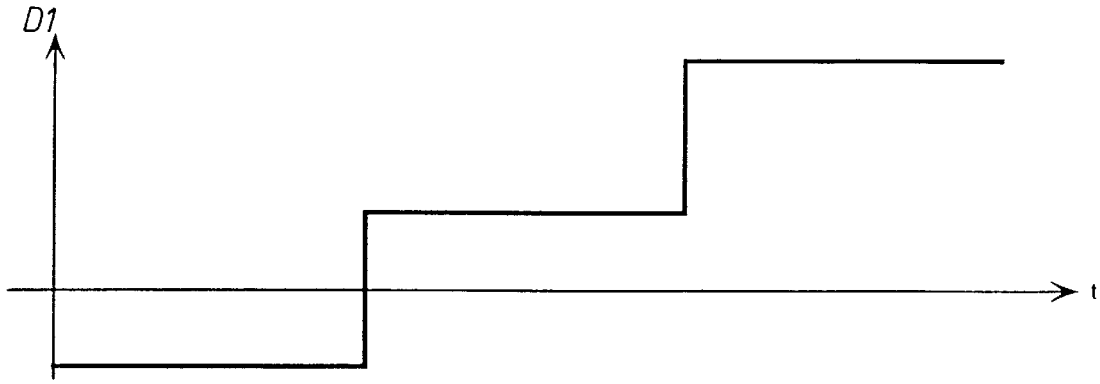
FIG. 6*b* illustrates a first deflection voltage signal as a function of time during a print cycle having three subsequent development periods
Figure 6C:
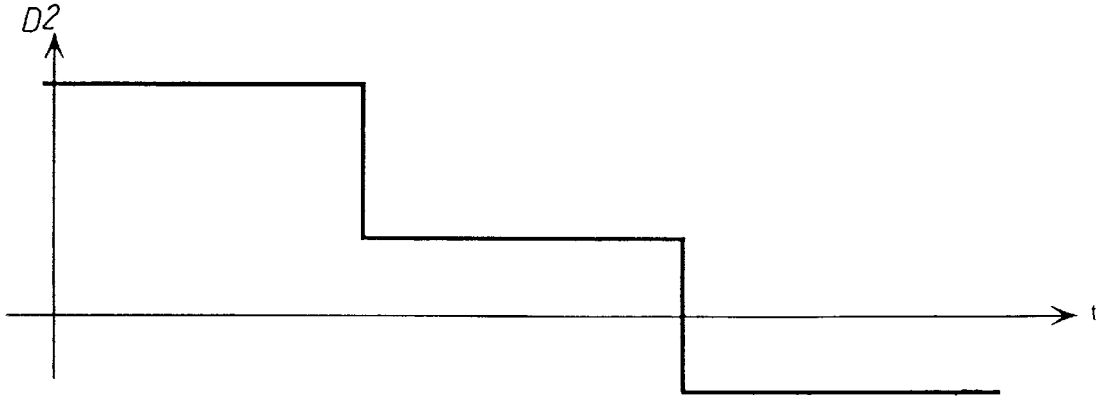
FIG. 6*c* illustrates a second deflection voltage signal as a function of time during a print cycle having three subsequent development periods

As apparent from FIGS. 6*b* and 6*c,* the amplitude difference between D1 and D2 is sequentially modified for providing three different toner trajectories, i.e. dot positions, during each print cycle. The amplitudes of D1 and D2 are modulated to apply converging forces on the toner to obtain smaller dots. Utilizing this method produces, for example, 60 $\mu$m dots utilizing 160 $\mu$m apertures. Suitably the size of the dots are adjusted in accordance with the dot density (dpi) and thus also dynamically with the number of dot locations each aperture is to address.

According to the invention, another method of increasing the apparent print resolution is to control the size of the individual dots not only in view of the dot density but also according to the image which is to be printed. Thus by being able to increase or decrease the size of individual dots, in dependence upon the image which is to be printed, especially edges can be improved, giving an improved image print quality. This dot size dependence on the image can be used on its own or in combination with the improved dot location control according to the invention.

Figure 7A:
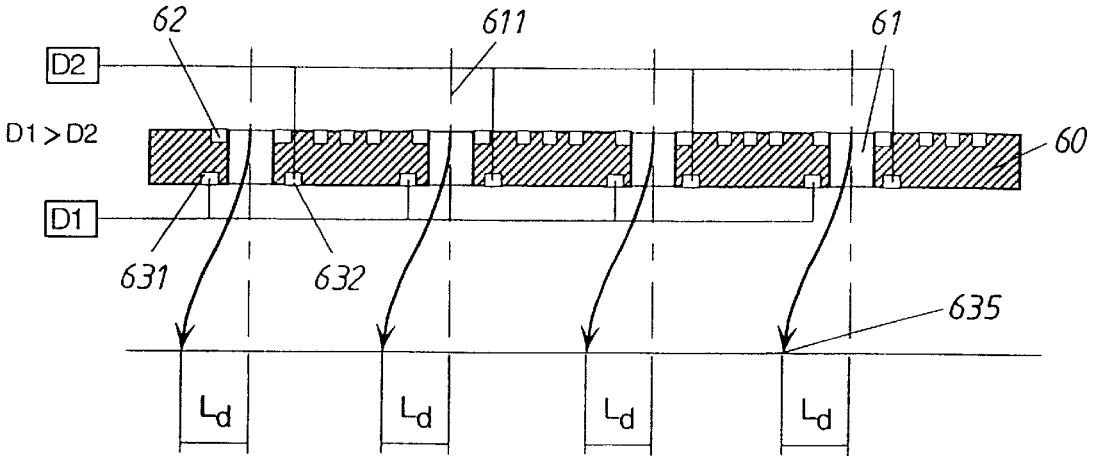
FIG. 7*a* illustrates the transport trajectory of toner particles through the printhead structure shown in FIGS. 4*a,b,c* according to a first deflection mode wherein D1>D2.
Figure 7B:
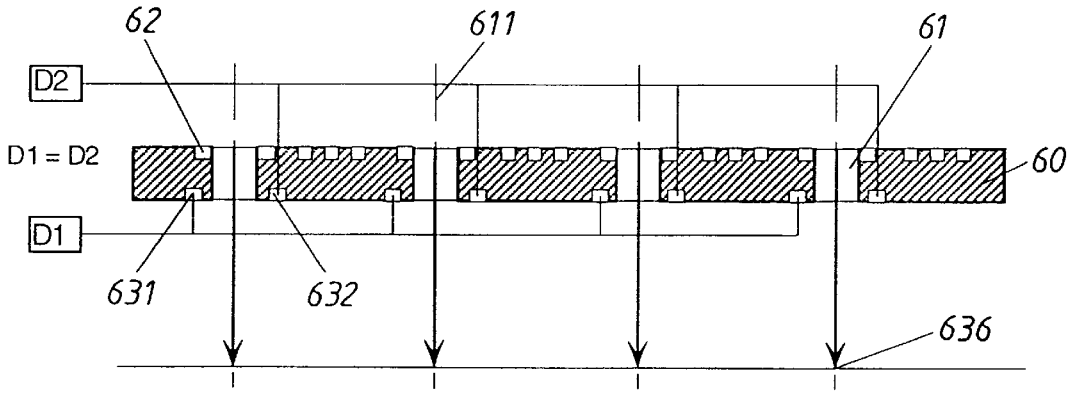
FIG. 7*b* illustrates the transport trajectory of toner particles through the printhead structure shown in FIGS. 4*a,b,c,* according to a second deflection mode wherein D1=D2.
Figure 7C:
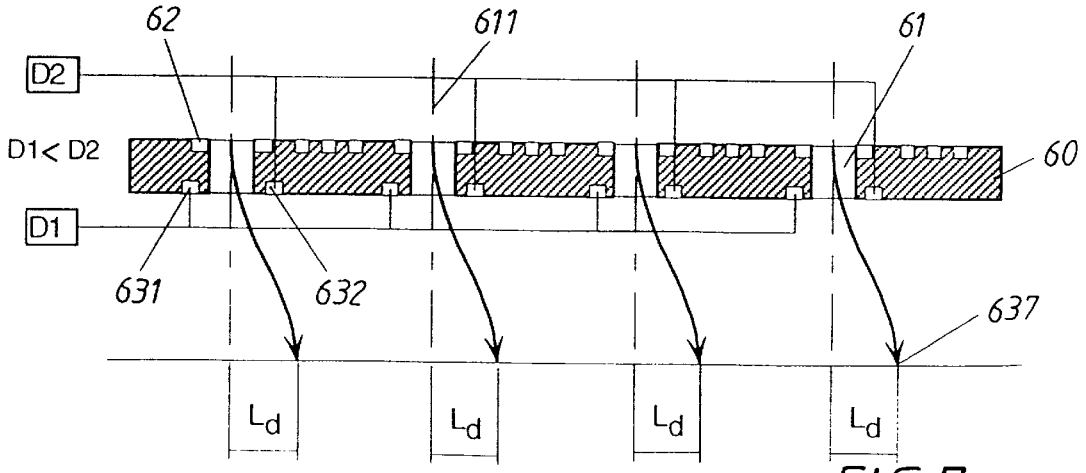
FIG. 7*c* illustrates the transport trajectory of toner particles through the printhead structure shown in FIGS. 4*a,b,c,* according to a third deflection mode wherein D1<D2.

FIGS. 7*a,* 7*b* and 7*c* illustrate the toner trajectories in three subsequent deflection modes. FIGS. 7*a,* 7*b* and 7*c* illustrate a cross section of a substrate layer 60 with apertures 61 with corresponding control electrodes 62. Also illustrated are deflection voltages D1 and D2 that are connected to respective deflection electrodes 631, 632. During a first development period illustrated in FIG. 7*a,* the modulated stream of toner particles is deflected to the left by producing a first amplitude difference (D1>D2) between both deflection voltages. The amplitude difference is adjusted to address dot locations 635 located at a deflection length $L_d$ to the left of the central axes 611 of the apertures 61. During a second development period illustrated in FIG. 7*b,* the deflection voltages have equal amplitudes (D1=D2) to address undeflected dot locations 636 coinciding with the central axes 611 of the apertures 61. During a third development period illustrated in FIG. 7*c,* the modulated stream of toner particles is deflected to the right by producing a second amplitude difference (D1<D2) between both deflection voltages. The amplitude difference is adjusted to address dot locations 637 located at a deflection length $L_d$ to the right of the central axes 611 of the apertures 61. As is apparent from the FIGS. 7*a–c,* the toner particles in question are negatively charged.

According to the invention, the control of the position of a dot location can be increased to produce an apparent increase of the print resolution. A method of achieving this according to the invention is to divide a print sequence into different parts with different deflection voltages by time multiplexing, i.e. during a first part, dots with normal deflection are printed and during a second or more parts, dots with a modified deflection are printed. Another method of achieving this according to the invention is to individually control the deflection of each print sequence, i.e. individually control the deflection voltages D1 and D2 of the deflection electrodes of each aperture to thereby individually adjust $L_d$ and possibly introduce a deflection of a center dot. By individually controlling the deflection voltages during each print sequence for each aperture, each dot location can be repositioned in a direction which is mainly perpendicular to the direction of travel of the image receiving member, information carrier, or transfer belt. Thus according to the invention, individual dot positions can be moved/adjusted leftward or rightward, i.e. in a direction perpendicular to the direction of travel of the information carrier, by adjusting the deflection voltages of the apertures.

Figure 8A:
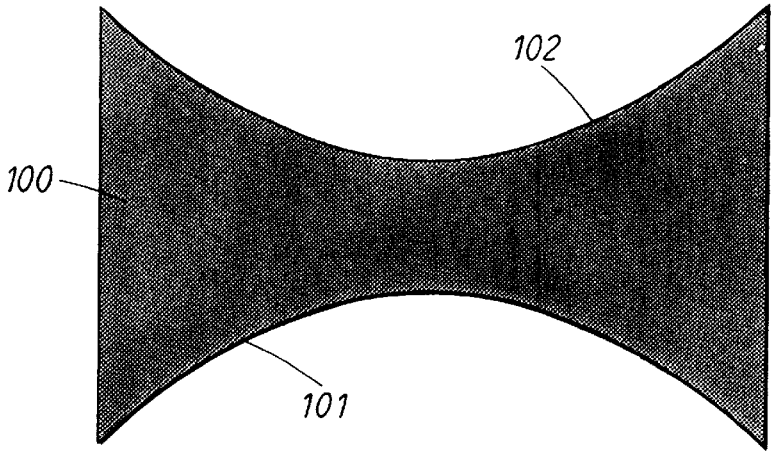
FIG. 8*a* illustrates a desired filled area to be printed enclosed by a first and a second boundary.
Figure 8B:
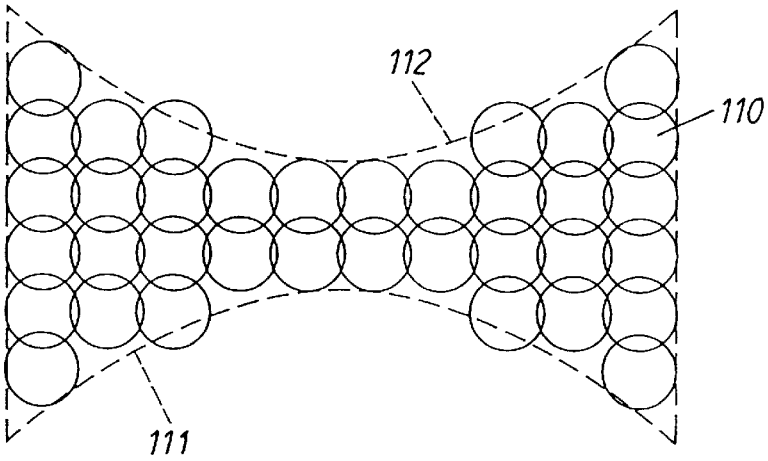
FIG. 8*b* illustrates a prior art method of filling the area of FIG. 8*a* with dots for printing.

FIG. 8*a* illustrates a desired filled area 100 to be printed enclosed by a first curved boundary 101 and a second curved boundary 102. A problem of printing such an area 100 is to be able to get smooth boundaries 101, 102. The printer resolution will produce jagged edges. FIG. 8*b* illustrates a prior art method of filling the area 100 of FIG. 8*a* with dots 110 for printing. This traditional method cannot produce smooth boundaries except where these boundaries are aligned with the dot matrix in the printer. As can be seen, some of the dots on the edges are completely within the ideal boundaries 111, 112, and some dots on the edges are dissected by the ideal boundaries 111, 112. Further, on some places there are big gaps on the insides of the ideal boundaries 111, 112. The result is a filled area with very jagged boundaries.

Figure 8C:
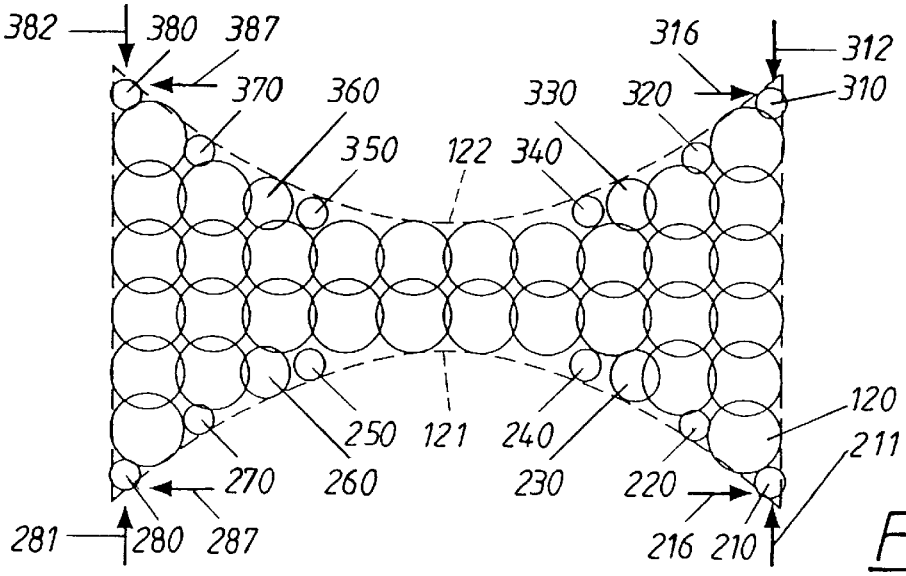
FIG. 8*c* illustrates a method according to the invention of filling the area of FIG. 8*a* with dots for printing.

According to the invention, preferably a preprocessor, e.g., a format controller, will identify and determine if a dot resides on an edge of an image feature such as a filled area or a line and, if so, select one or more of the dot modifications to one or more dots to enhance the appearance of the printed edge. Preferably dots will be adjusted from an unfilled area towards a filled area otherwise holes in the filled area might result if dots are adjusted from a filled area. FIG. 8*c* illustrates a method according to the invention of filling the area 100 of FIG. 8*a* with dots 120 for printing. According to the invention several dots 210, 220, 230, 240, 250, 260, 270, 310, 320, 330, 340, 350, 360, 370, 380 along the edge are position adjusted 211, 216, 281, 287, 312, 316, 382, 387 and/or size adjusted beyond the nominal dot matrix to thereby improve the edge smoothness enabling a better fit to the ideal boundries 121, 122. Position adjustment beyond the nominal dot matrix can according to the invention, as described previously, be accomplished by time displacement of the opening and closing of each aperture of a dot in question and/or displacing the deflection voltages of the aperture of a dot in question. A combination of these adjustments accomplishes a possible two-dimensional positional adjustment control of each dot in the matrix. Depending on the specific embodiment, only one of these might be available, which will then restrict the possible positional adjustment to only one dimension.

As is clear from FIG. 8*c,* an adjustment of the dot size is also advantageous to increase the perceived resolution. An adjustment of dot size in combination with either one or both positional adjustments according to the invention will greatly enhance the perceived resolution and be able to provide smoother edges, even if the edges are not aligned with the dot matrix. In the example illustrated in FIG. 8*c,* the adjustment of the size of the dots has only been to sizes smaller than the nominal print size, but in other circumstances the size of the dots can also be increased in relation to their nominal size to enhance the apparent print resolution.

The invention is not limited to the embodiments described above but may be varied within the scope of the appended patent claims.

What is claimed is:

1. A direct electrostatic printing device which prints an image onto an information carrier, the device comprising:

a pigment particle source, which provides pigment particles;

a voltage source;

a control unit;

at least one printhead structure having a plurality of apertures through the at least one printhead structure and having control electrodes proximate to the apertures, the control electrodes being coupled to the control unit;

a back electrode; and an image receiving member; wherein:

the image receiving member and the at least one printhead structure move relative to each other during printing;

the image receiving member has a first face and a second face;

the at least one printhead structure is positioned between the pigment particle source and the first face of the image receiving member;

the voltage source is connected to the pigment particle source and the back electrode to thereby create an electrical field for transport of pigment particles from the pigment particle source toward the first face of the image receiving member;

the control electrodes of the at least one printhead structure are responsive to the control unit to thereby selectively open or close the apertures through the at least one printhead structure to permit or restrict the transport of pigment particles to form a pigment image on the first face of the image receiving member nominally aligned with a dot matrix; and the control unit controls the transport of pigment particles by controllably applying time displacements to the selective opening and closing of apertures to thereby adjust a dot position from the dot matrix in a direction mainly parallel to the direction of the relative movement between the image receiving member and the at least one printhead structure, so that edges of image features not aligned with the dot matrix of the image printed onto the information carrier appear smoother.

2. A direct electrostatic printing device according to claim 1, wherein the time displacements can be either positive or negative depending upon the edges of image features of the image printed onto the information carrier.

3. A direct electrostatic printing device according to claim 1, wherein the printing device further includes a format controller that determines if an image dot resides at an edge of an image feature of an image to be printed onto the information carrier and, if so, selects a dot modification to thereby make the edge appear smoother and where the format controller also generates commands to the control unit for control of the transport of pigment particles depending upon the possible selected dot modifications.

4. A direct electrostatic printing device according to claim 1, wherein the image receiving member is an information carrier.

5. A direct electrostatic printing device according to claim 1, wherein the image receiving member includes a transfer belt having a first face and a second face positioned at a predetermined distance from the at least one printhead structure, the transfer belt being of substantially uniform thickness, whereby the pigment image is subsequently transferred to an information carrier.

6. A direct electrostatic printing device according to claim 5, wherein the transfer belt is supported by at least one holding element arranged on the side of the second face of the transfer belt adjacent to a print station.

7. A direct electrostatic printing device according to claim 5, wherein the first face of the image receiving member is substantially evenly coated with a layer of bouncing reduction agent thus providing a surface on the first face of the image receiving member that the pigment particles transported through the at least one printhead structure adhere to substantially without bouncing.

8. A direct electrostatic printing device according to claim 7, wherein the bouncing reduction agent is a liquid having adhesion properties suitable for the adhesion of pigment particles to the first face of the image receiving member and wherein the image printing device further comprises a film application means for applying the bouncing reduction agent liquid substantially evenly as a film layer onto the first face of the image receiving member.

9. A direct electrostatic printing device according to claim 8, wherein the bouncing reduction agent is a silicone oil having appropriate adhesion properties for reducing bouncing of pigment particles when pigment particles are transferred onto the first face of the image receiving means and also having appropriate release properties when a pigment image is transferred to an information carrier from the image receiving member.

10. A direct electrostatic printing device according to claim 5, wherein the image printing device further comprises a fuser unit having heating means and pressurizing means for transferring the pigment image on the surface of the first face of the image receiving member to an information carrier by locally applying heat and pressure to the information carrier and the pigment image by the heating means and pressurizing means, thereby transferring the pigment image to the information carrier.

11. A direct electrostatic printing device according to claim 1, wherein the printing device includes at least two pigment particle sources with corresponding control electrodes and apertures on and in at least one printhead structure.

12. A direct electrostatic printing device according to claim 1, wherein the image printing device includes four pigment particle sources with corresponding control electrodes and apertures on and in at least one printhead structure.

13. A direct electrostatic printing device according to claim 1, wherein the at least one printhead structure includes deflection electrodes proximate to the apertures and connected to the control unit to deflect pigment particles toward predetermined locations on the first face of the image receiving member in view of the image printed onto the information carrier.

14. A direct electrostatic printing device which prints an image onto an information carrier, the device comprising:

a pigment particle source, which provides pigment particles;

a voltage source;

a control unit;

at least one printhead structure having a plurality of apertures through the at least one printhead structure and having control electrodes proximate to the apertures, the control electrodes being coupled to the control unit;

a back electrode; and an image receiving member; wherein:

the image receiving member and the at least one printhead structure move relative to each other during printing;

the image receiving member has a first face and a second face;

the at least one printhead structure is positioned between the pigment particle source and the first face of the image receiving member;

the voltage source is connected to the pigment particle source and the back electrode to thereby create an electrical field for transport of pigment particles from the pigment particle source toward the first face of the image receiving member;

the control electrodes of the at least one printhead structure are responsive to the control unit to thereby selectively open or close the apertures through the at least one printhead structure to permit or restrict the transport of pigment particles to form a pigment image on the first face of the image receiving member nominally aligned with a dot matrix;

the at least one printhead structure includes deflection electrodes proximate to the apertures, and connected to the control unit for controlling the deflection of pigment particles in transport to thereby deflect pigment particles toward predetermined locations nominally according to the dot matrix on the first face of the image receiving member in view of the image printed onto the information carrier by means of predetermined deflection voltages, whereby the control unit controllably adjusts the deflection voltages to thereby adjust a dot position from the dot matrix, in a direction mainly perpendicular to the direction of the relative movement between the image receiving member and the at least one printhead structure; and the control unit controls the transport of pigment particles by controllably adjusting the deflection voltages to adjust the size of dots, so that edges of image features not aligned with the dot matrix of the image printed onto the information carrier appear smoother.

15. A direct electrostatic printing device according to claim 14, wherein the printing device further includes a format controller that determines if an image dot resides at an edge of an image feature of an image to be printed onto the information carrier and, if so, selects a dot modification to thereby make the edge appear smoother and where the format controller also generates commands to the control unit for control of the transport of pigment particles depending upon the possible selected dot modifications.

16. A direct electrostatic printing device which prints an image onto an information carrier, the device comprising:

a pigment particle source, which provides pigment particles;

a voltage source;

a control unit;

at least one printhead structure having a plurality of apertures through the at least one printhead structure and having control electrodes proximate to the apertures, the control electrodes being coupled to the control unit;

a back electrode; and an image receiving member; wherein:

the image receiving member and the at least one printhead structure move relative to each other during printing;

the image receiving member has a first face and a second face;

the at least one printhead structure is positioned between the pigment particle source and the first face of the image receiving member;

the voltage source is connected to the pigment particle source and the back electrode to thereby create an electrical field for transport of pigment particles from the pigment particle source toward the first face of the image receiving member;

the control electrodes of the at least one printhead structure are responsive to the control unit to thereby selectively open or close the apertures through the at least one printhead structure to permit or restrict the transport of pigment particles to form a pigment image on the first face of the image receiving member nominally aligned with a dot matrix;

the control unit controls the transport of pigment particles; and the at least one printhead structure includes deflection electrodes proximate to the apertures and connected to the control unit for controlling the deflection of pigment particles in transport to thereby deflect pigment particles toward predetermined locations nominally according to the dot matrix on the first face of the image receiving member in view of the image printed onto the information carrier by means of predetermined deflection voltages, whereby the control unit controllably adjusts the deflection voltages to adjust the size of dots, so that edges of image features not aligned with the dot matrix of the image printed onto the information carrier appear smoother.

17. A direct electrostatic printing device according to claim 16, wherein the printing device further includes a format controller that determines if an image dot resides at an edge of an image feature of an image to be printed onto the information carrier and, if so, selects a dot modification to thereby make the edge appear smoother and where the format controller also generates commands to the control unit for control of the transport of pigment particles depending upon the possible selected dot modifications.

18. A direct electrostatic printing device which prints an image onto an information carrier, the device comprising:

a pigment particle source, which provides pigment particles;

a voltage source;

a control unit;

at least one printhead structure having a plurality of apertures through the at least one printhead structure and having control electrodes proximate to the apertures, the control electrodes being coupled to the control unit;

a back electrode; and an image receiving member; wherein:

the image receiving member and the at least one printhead structure move relative to each other during printing;

the image receiving member has a first face and a second face;

the at least one printhead structure is positioned between the pigment particle source and the first face of the image receiving member;

the voltage source is connected to the pigment particle source and the back electrode to thereby create an electrical field for transport of pigment particles from the pigment particle source toward the first face of the image receiving member;

the control electrodes of the at least one printhead structure are responsive to the control unit to thereby selectively open or close the apertures through the at least one printhead structure to permit or restrict the transport of pigment particles to form a pigment image on the first face of the image receiving member nominally aligned with a dot matrix; and the control unit controls the transport of pigment particles by controllably applying time displacements to the selective opening and closing of apertures to thereby adjust a dot position from the dot matrix, in a direction mainly parallel to the direction of the relative movement between the image receiving member and the at least one printhead structure, and, where the at least one printhead structure includes deflection electrodes proximate to the apertures and connected to the control unit for controlling the deflection of pigment particles in transport to thereby deflect pigment particles toward predetermined locations nominally according to the dot matrix on the first face of the image receiving member in view of the image printed onto the information carrier by means of predetermined deflection voltages, whereby the control unit controllably adjusts the deflection voltages to thereby adjust a dot position from the dot matrix, in a direction mainly perpendicular to the direction of the relative movement between the image receiving member and the at least one printhead structure, so that in combination a dot position is adjusted in two dimensions from the dot matrix, thus making edges of image features not aligned with the dot matrix of the image printed onto the information carrier to appear smoother.

19. A direct electrostatic printing device according to claim 18, wherein the printing device further includes a format controller that determines if an image dot resides at an edge of an image feature of an image to be printed onto the information carrier and, if so, selects a dot modification to thereby make the edge appear smoother and where the format controller also generates commands to the control unit for control of the transport of pigment particles depending upon the possible selected dot modifications.

20. A direct electrostatic printing device which prints an image onto an information carrier, the device comprising:

a pigment particle source, which provides pigment particles;

a voltage source;

a control unit;

at least one printhead structure having a plurality of apertures through the at least one printhead structure and having control electrodes proximate to the apertures, the control electrodes being coupled to the control unit;

a back electrode; and an image receiving member; wherein:

the image receiving member and the at least one printhead structure move relative to each other during printing;

the image receiving member has a first face and a second face;

the at least one printhead structure is positioned between the pigment particle source and the first face of the image receiving member;

the voltage source is connected to the pigment particle source and the back electrode to thereby create an electrical field for transport of pigment particles from the pigment particle source toward the first face of the image receiving member;

the control electrodes of the at least one printhead structure are responsive to the control unit to thereby selectively open or close the apertures through the at least one printhead structure to permit or restrict the transport of pigment particles to form a pigment image on the first face of the image receiving member nominally aligned with a dot matrix;

the control unit controls the transport of pigment particles; and the image printing device comprises an image receiving member position measuring means for measuring the position of the image receiving member in relation to the apertures so that the control unit synchronizes the selective opening and closing of the apertures through the at least one printhead structure according to the relative movement of the at least one printhead structure and the image receiving member to form a pigment image at a predetermined position on the image receiving member in view of the image printed onto the information carrier, so that edges of image features of the image printed onto the information carrier which are not aligned with the dot matrix appear smoother.

21. A direct electrostatic printing device according to claim 20, wherein the image printing device includes at least two pigment particle sources with corresponding control electrodes and apertures on the at least one printhead structure, whereby the image receiving member position measuring means measures the position of the image receiving member in relation to the respective apertures so that the control unit synchronizes the selective opening and closing of the respective apertures through the at least one printhead structure according to the relative movement of the at least one printhead structure and the image receiving member to form the pigment image at a predetermined position on the image receiving member in view of the image printed onto the information carrier.

22. A direct electrostatic printing device according to claim 21, wherein the image printing device prints color images and includes four pigment particle sources.

23. A direct electrostatic printing device which prints an image onto an information carrier, the device comprising:

a pigment particle source, which provides pigment particles;

a voltage source;

a control unit;

at least one printhead structure having a plurality of apertures through the at least one printhead structure and having control electrodes proximate to the apertures, the control electrodes being coupled to the control unit;

a back electrode; and an image receiving member; wherein:

the image receiving member and the at least one printhead structure move relative to each other during printing;

the image receiving member has a first face and a second face;

the at least one printhead structure is positioned between the pigment particle source and the first face of the image receiving member;

the voltage source is connected to the pigment particle source and the back electrode to thereby create an electrical field for transport of pigment particles from the pigment particle source toward the first face of the image receiving member;

the control electrodes of the at least one printhead structure are responsive to the control unit to thereby selectively open or close the apertures through the at least one printhead structure to permit or restrict the transport of pigment particles to form a pigment image on the first face of the image receiving member nominally aligned with a dot matrix;

the control unit controls the transport of pigment particles;

the image receiving member includes a transfer belt having a first face and a second face, positioned at a predetermined distance from the at least one printhead structure, the transfer belt being of substantially uniform thickness, whereby a pigment image is subsequently transferred to an information carrier; and the image printing device comprises a pressure changing means which creates a pressure difference on the side of the second face of the image receiving member in the vicinity of the apertures of the at least one printhead structure, and where the image receiving member comprises a cleaning area for cleaning purposes and a separate image area intended for reception of pigment particles for formation of a pigment image thereon, where the cleaning area includes at least one slot between the first face and the second face intended for transmitting the pressure difference through the image receiving member to thereby, in cooperation with the pressure changing means in the vicinity of the apertures of the at least one printhead structure, dislodge pigment agglomeration for cleaning the apertures of the at least one printhead structure, so that edges of image features of the image printed onto the information carrier which are not aligned with the dot matrix appear smoother.

24. A direct electrostatic printing device which prints an image onto an information carrier, the device comprising:

a pigment particle source, which provides pigment particles;

a voltage source;

a control unit;

at least one printhead structure having a plurality of apertures through the at least one printhead structure and having control electrodes proximate to the apertures, the control electrodes being coupled to the control unit;

a back electrode; and an image receiving member; wherein:

the image receiving member and the at least one printhead structure move relative to each other during printing;

the image receiving member has a first face and a second face;

the at least one printhead structure is positioned between the pigment particle source and the first face of the image receiving member;

the voltage source is connected to the pigment particle source and the back electrode to thereby create an electrical field for transport of pigment particles from the pigment particle source toward the first face of the image receiving member;

the control electrodes of the at least one printhead structure are responsive to the control unit to thereby selectively open or close the apertures through the at least one printhead structure to permit or restrict the transport of pigment particles to form a pigment image on the first face of the image receiving member nominally aligned with a dot matrix;

the control unit controls the transport of pigment particles; and the at least one printhead structure includes deflection electrodes proximate to the apertures and connected to the control unit for controlling the deflection of pigment particles in transport, and where the image printing device further comprises deflection control feedback means for providing a deflection feedback signal to the control unit to thereby control the deflection electrodes in such a way that pigment particles are trajected toward predetermined locations on the image receiving member to form a pigment image on the image receiving member, so that edges of image features of the image printed onto the information carrier which are not aligned with the dot matrix appear smoother.

25. A method for printing an image to an information carrier, wherein the method comprises:

providing pigment particles from a pigment particle source;

moving an image receiving member and at least one printhead structure relative to each other during printing;

creating an electrical field for transporting of pigment particles from the pigment particle source toward a first face of the image receiving member;

selectively opening or closing apertures through the at least one printhead structure to permit or restrict the transporting of pigment particles to form a pigment image on the first face of the image receiving member nominally aligned with a dot matrix; and controlling the transport of pigment particles by controllably applying time displacements to the selective opening and closing of apertures to thereby adjust a dot position from the dot matrix in a direction mainly parallel to the direction of the relative movement between the image receiving member and the at least one printhead structure, in such a way that edges of image features of the image printed onto the information carrier not aligned with the dot matrix appear smoother.

26. A direct electrostatic printing device which prints an image onto an information carrier, the device comprising:

a pigment particle source, which provides pigment particles;

a voltage source;

a control unit;

at least one printhead structure having a plurality of apertures through the at least one printhead structure and having control electrodes proximate to the apertures, the control electrodes being coupled to the control unit;

a back electrode;

an image receiving member; and a format controller that determines if an image dot resides at an edge of an image feature of an image to be printed onto the information carrier and, if so, selects a dot modification to thereby make the edge appear smoother and where the format controller also generates commands to the control unit for control of the transport of pigment particles depending upon the possible selected dot modifications; wherein:

the image receiving member and the at least one printhead structure move relative to each other during printing;

the image receiving member has a first face and a second face;

the at least one printhead structure is positioned between the pigment particle source and the first face of the image receiving member;

the voltage source is connected to the pigment particle source and the back electrode to thereby create an electrical field for transport of pigment particles from the pigment particle source toward the first face of the image receiving member;

the control electrodes of the at least one printhead structure are responsive to the control unit to thereby selectively open or close the apertures through the at least one printhead structure to permit or restrict the transport of pigment particles to form a pigment image on the first face of the image receiving member nominally aligned with a dot matrix;

the control unit controls the transport of pigment particles; and the at least one printhead structure includes deflection electrodes proximate to the apertures, and connected to the control unit for controlling the deflection of pigment particles in transport to thereby deflect pigment particles toward predetermined locations nominally according to the dot matrix on the first face of the image receiving member in view of the image printed onto the information carrier by means of predetermined deflection voltages, whereby the control unit controllably adjusts the deflection voltages to thereby adjust a dot position from the dot matrix, in a direction mainly perpendicular to the direction of the relative movement between the image receiving member and the at least one printhead structure, so that edges of image features not aligned with the dot matrix of the image printed onto the information carrier appear smoother.

27. A method for printing an image to an information carrier, wherein the method comprises:

providing pigment particles from a pigment particle source;

moving an image receiving member and at least one printhead structure relative to each other during printing;

creating an electrical field for transporting of pigment particles from the pigment particle source toward a first face of the image receiving member;

selectively opening or closing apertures through the at least one printhead structure to permit or restrict the transporting of pigment particles to form a pigment image on the first face of the image receiving member nominally aligned with a dot matrix; and controlling the transport of pigment particles by deflecting pigment particles toward predetermined locations nominally according to the dot matrix on the first face of the image receiving member in view of the image printed onto the information carrier by means of predetermined deflection voltages by adjusting the deflection voltages to thereby adjust a dot position from the dot matrix, in a direction mainly perpendicular to the direction of the relative movement between the image receiving member and the at least one printhead structure, and by controllably adjusting the deflection voltages to adjust the size of dots in such a way that edges of image features of the image printed onto the information carrier not aligned with the dot matrix appear smoother.

28. A method for printing an image to an information carrier, wherein the method comprises:

providing pigment particles from a pigment particle source;

moving an image receiving member and at least one printhead structure relative to each other during printing;

creating an electrical field for transporting of pigment particles from the pigment particle source toward a first face of the image receiving member;

selectively opening or closing apertures through the at least one printhead structure to permit or restrict the transporting of pigment particles to form a pigment image on the first face of the image receiving member nominally aligned with a dot matrix; and controlling the transport of pigment particles by deflecting pigment particles toward predetermined locations nominally according to the dot matrix on the first face of the image receiving member in view of the image printed onto the information carrier by means of predetermined deflection voltages and by controllably adjusting the deflection voltages to adjust the size of dots in such a way that edges of image features of the image printed onto the information carrier not aligned with the dot matrix appear smoother.

29. A method for printing an image to an information carrier, wherein the method comprises:

providing pigment particles from a pigment particle source;

moving an image receiving member and at least one printhead structure relative to each other during printing;

creating an electrical field for transporting of pigment particles from the pigment particle source toward a first face of the image receiving member;

selectively opening or closing apertures through the at least one printhead structure to permit or restrict the transporting of pigment particles to form a pigment image on the first face of the image receiving member nominally aligned with a dot matrix; and controlling the transport of pigment particles by controllably applying time displacements to the selective opening and closing of apertures to thereby adjust a dot position from the dot matrix, in a direction mainly parallel to the direction of the relative movement between the image receiving member and the at least one printhead structure and by deflecting pigment particles toward predetermined locations nominally according to the dot matrix on the first face of the image receiving member in view of the image printed onto the information carrier by means of predetermined deflection voltages, and controllably adjusting the deflection voltages to thereby adjust a dot position from the dot matrix, in a direction mainly perpendicular to the direction of the relative movement between the image receiving member and the at least one printhead structure, so that in combination a dot position is adjusted in two dimensions from the dot matrix in such a way that edges of image features of the image printed onto the information carrier not aligned with the dot matrix appear smoother.

* * * * *